United States Patent [19]

Brown et al.

[11] 4,197,340

[45] Apr. 8, 1980

[54] DRAWING COMPOSITION AND PROCESS

[75] Inventors: Kevin Brown; Dennis B. Freeman, both of Middlesex; Alan J. Koch, Uxbridge, all of England

[73] Assignees: Oxy Metal Industries Corporation, Warren, Mich.; Oxy Metal Industries Corporation, Warren, Mich.

[21] Appl. No.: 768,814

[22] Filed: Feb. 15, 1977

[30] Foreign Application Priority Data

Feb. 20, 1976 [GB] United Kingdom ..... 6749/76

[51] Int. Cl.[2] ..... B05D 3/02; C10M 3/04

[52] U.S. Cl. ..... 427/372.2; 72/42; 252/25; 252/28; 252/49.3; 427/397.8

[58] Field of Search ..... 252/18.25, 49.3, 28; 72/42; 427/372 R, 372 B

[56] References Cited

U.S. PATENT DOCUMENTS

| | | | |
|---|---|---|---|
| 3,313,728 | 4/1967 | Glasson et al. | 252/25 X |
| 3,826,744 | 7/1974 | Holinski et al. | 252/25 X |

OTHER PUBLICATIONS

Noller, Carl R., *Chemistry of Organic Compounds,* W. B. Saunders Co., Philadelphia, 1965, pp. 787, 830.

*Primary Examiner*—Evan K. Lawrence

*Attorney, Agent, or Firm*—Arthur E. Kluegel; Richard P. Mueller; Arthur E. Kluegel

[57] ABSTRACT

Disclosed are a composition and process useful for drawing stainless steel and nickel alloy wire and rods. The wire or rod is contacted with an aqueous solution consisting essentially of at least one alkali metal borate and at least one alkali metal sulphate, which solution is essentially free of silicate and chloride.

8 Claims, No Drawings

DRAWING COMPOSITION AND PROCESS

BACKGROUND OF THE INVENTION

In the art of the drawing of stainless steel and nickel alloy wire and rods, older methods of providing a lubricant or lubricant carrier coating such as a lead coating, an oxalate coating or lime coating have been largely superseded by salt coatings. These salt coatings are formed by immersion is concentrated solutions containing sodium chloride, borax and sodium metasilicate.

Such compounds have enabled high speed multi-hole drawing to be carried out but suffer from the disadvantage that residual chloride on the wire after drawing can give rise to pitting corrosion. Attempts have been made to overcome this problem by replacing the sodium chloride with alkali metal sulphates but these have given rise to further problems in that the coatings produced are hygroscopic and pick up water at such a rate as to seriously impair drawing performance.

SUMMARY OF THE INVENTION

We have now discovered that non-corrosive and non-hygroscopic coatings can be obtained by using compositions containing alkali metal borates and alkali metal sulphates, essentially free from silicate and chloride (less than 0.2% by weight of each radical, based on the weight of the dry composition), in which the radicals are present in the following ratios (by weight): borate (as $B_2O_3$):sulphate (as $SO_4$):alkali metal (as Na and/or K) of 1:1.5 to 12:1.5 to 8. The preferred weight ratio of $B_2O_3$:$SO_4$:Na and/or K is 1:3 to 12:3 to 8.

DETAILED DESCRIPTION OF THE INVENTION

By "essentially free from silicate and chloride", we mean that the compositions of the invention contain less silicate and chloride than previous equivalent compositions, i.e., less than 5%, preferably less than 2%, more preferably less than 1% and most preferably less than 0.2% by weight of each radical, based on the weight of the dry composition. Often the compositions contain neither radical.

Optionally, the compositions may also contain alkali metal nitrates (to increase the weight of alkali metal), alkali metal oxalates (to improve the quality of the coatings) and/or an amino carboxylic acid sequestering agent, provided that the total alkali metal content remains within the ratios above. A suitable sequestering agent is ethylene diamine tetracetic acid (EDTA) and this serves to prevent precipitation of sulphate ions by calcium when the novel composition is used in hard water.

The compositions of the invention can conveniently be provided in solid form, and diluted with water for use as an aqueous solution. In use, the materials are preferably used at a concentration of from 200 to 300 g/l, and at 90° C. or above. The coatings are formed by contacting the relevant workpiece, e.g., by immersing a wire, in the solution, suitably for 5 to 10 minutes. The workpiece is then removed and dried, thus forming the coating.

Unless otherwise indicated, references to percentages in this specification are percentages by weight.

The following are Examples of solid compositions illustrating the invention, and which can be diluted for use.

EXAMPLE 1

Potassium sulphate ($K_2SO_4$)—50%
Borax ($Na_2B_4O_7.10H_2O$)—25%
Potassium nitrate ($KNO_3$)—25%

EXAMPLE 2

Potassium sulphate—50%
Borax—46%
Potassium oxalate—4%

EXAMPLE 3

Sodium sulphate ($Na_2SO_4$)—75%
Borax—24.5%
EDTA—0.5%

The composition of Example 3 was diluted to a concentration of 200 g/l and used to coat stainless steel wire at 95° C. by immersion for 5 minutes. The wire was dried for 15 minutes at 110° C. and on cooling showed no tendency to rehydration.

The coated wire was successfully drawn from 0.080 inch diameter to 0.030 inch diameter through 6 dies. By way of comparison, the following two solid compositions were made up:

EXAMPLE 4

Potassium sulphate—50%
Sodium metasilicate ($Na_2SiO_3.5H_2O$)—25%
Borax—25%

EXAMPLE 5

Potassium sulphate—50%
Borax (anhydrous)—25%
Sodium metaborate ($NaBO_2.4H_2O$)—25%

The sodium metaborate component contains 25.3% $B_2O_3$, and the $B_2O_3$:$SO_4$:Na+K ratio for the composition of Example 5 is approximately 1:1.2:1.4.

The compositions of Examples 4 and 5 were used under the same conditions as that of Example 3 but in both cases severe rehydration of the wire occurred after drying and it was not possible to draw the coated wire.

What we claim is:

1. A solid composition consisting essentially of at least one alkali metal borate and at least one alkali metal sulphate in which the composition contains less than 0.2 wt. % of each of silicate and chloride radicals and in which the essential radicals are present in the weight ratio of borate (as $B_2O_3$):sulphate:alkali metal of 1:1.5 to 12:1.5 to 8.

2. A composition according to claim 1 additionally containing an alkali metal oxalate.

3. A composition according to claim 1 in which the alkali metal is Na and/or K and wherein the weight ratio of $B_2O_3$:$SO_4$:Na and/or K is 1:3 to 12:3 to 8.

4. A composition according to claim 1 additionally containing an amino carboxylic acid sequestering agent.

5. A composition according to claim 4 in which the sequestering agent is ethylene diamine tetracetic acid.

6. A composition according to claim 1 in the form of an aqueous solution containing 200 to 300 g/l of the solid composition.

7. A process for coating a stainless steel or nickel alloy wire or rod comprising contacting the wire or rod with the aqueous solution of claim 6 and thereafter drying to form a coating on the wire or rod.

8. The process of claim 7 wherein the aqueous solution is maintained at a temperature of at least 90° C.

* * * * *